United States Patent [19]

Luperti et al.

[11] Patent Number: 4,621,966

[45] Date of Patent: Nov. 11, 1986

[54] SHINGLE COMPENSATING DEVICE

[75] Inventors: Harry E. Luperti, Bethel; Anthony Luvara, Stamford, both of Conn.

[73] Assignee: Pitney Bowes Inc., Stamford, Conn.

[21] Appl. No.: 627,140

[22] Filed: Jul. 2, 1984

[51] Int. Cl.[4] ..... B65H 31/40; B41F 13/54

[52] U.S. Cl. ..... 414/43; 271/213; 493/421

[58] Field of Search ..... 271/65, 186, 216, 213; 493/420, 421; 414/35, 43

[56] References Cited

U.S. PATENT DOCUMENTS

| | | | |
|---|---|---|---|
| 3,150,871 | 9/1964 | Boblit, Jr. et al. | 493/421 |
| 4,223,882 | 9/1980 | Stocker | 493/420 X |
| 4,247,093 | 1/1981 | Kistner et al. | 414/32 X |
| 4,453,870 | 6/1984 | Bean | 414/43 |

FOREIGN PATENT DOCUMENTS

| | | | |
|---|---|---|---|
| 1071101 | 12/1959 | Fed. Rep. of Germany | 414/35 |

*Primary Examiner*—Robert J. Spar
*Assistant Examiner*—Janice Krizek
*Attorney, Agent, or Firm*—Martin D. Wittstein; William D. Soltow, Jr.; Albert W. Scribner

[57] ABSTRACT

A machine for accumulating and for stacking a plurality of documents in a first plane so that the leading end of the documents are in a shingled relationship. Upon actuation of a system of first and second pairs of feed rollers, the documents in a stack are fed along a path leading to an angularly disposed, first buckle chute of a folding device. While traveling within the first buckle chute, the first and second pairs of feed rollers cause the leading end of the stack of documents to become aligned in relationship, thereby providing squarely folded groups of documents when the folds are made in a folding device within the machine.

5 Claims, 3 Drawing Figures

SHINGLE COMPENSATING DEVICE

FIELD OF THE INVENTION

The present invention is directed to a device for stacking a plurality of documents such that the leading edge of the documents is shingled prior to folding the documents together. The shingled relationship of the stack of documents assures that the resulting fold on each individual document is equal to that of any other.

BACKGROUND OF THE INVENTION

Typically, single discreet documents are folded and advanced along a path of travel in a machine having an inserting apparatus for receiving the folded document into an envelope. There are inserting machines in use in the field which are adapted to have multiple station feeding devices for feeding $8\frac{1}{2}\times 11$ inch, single documents to a folding device. The folded documents are then inserted to a waiting envelope located at a downstream location of the machine. Currently, there is a requirement to rapidly accumulate, and then fold a plurality of documents which have been prestacked at a registration position. The result is that a folded set of documents is produced which represents a single package suitable for insertion into an envelope.

In both of the preceding described instances, the discreet documents are generated from perforated, continuous webs which are guided through a bursting apparatus position at an upstream location in the path of travel of the documents through the apparatus. A receiving and supporting station is located downstream in the path of travel, such that the stack of documents is accumulated on a support surface prior to entering the folding device.

There is a problem with respect to accurately folding a stack of documents at one time since the paper path of the documents to be folded must be such that the documents are guided along an angular path away from the normal path of travel constituting a substantially straight path through the apparatus. When the stack of documents is guided along such a diverted angular path, the outermost document of the stack travels a shorter distance than the inside document when the stack is positively pushed or conveyed by cooperating pairs of feeding rollers. The result is that no two of the documents in the folded stack have exactly the same fold and, as mentioned, this creates a problem where there are varying folded sizes of the documents, some of which may exceed the size of the opened envelope, thereby preventing insertion.

Therefore, the present invention has evolved, and is briefly described within the following summary where the benefits of the invention are explained.

SUMMARY OF THE INVENTION

The present invention is directed to a machine for accumulating and for stacking a plurality of documents in a first plane with the lead edge of the documents in a shingled relationship and for feeding the accumulated stack of documents to a second plane disposed at an angle to the first plane with the lead edge of the documents in aligned relationship.

More broadly, the present invention is related to a machine for accumulating and for stacking a plurality of documents with the lead edge in shingled relationship to effect a uniform fold on the stack of documents and therefore on the individual documents. To this end, there is a first pair of feed rollers mounted such that one roller thereof is movable toward and away from the other. The one roller is biased towards the other in driving engagement therewith so as to normally define a nip between the pair of feed rollers with a bias sufficiently yieldable to permit a stack of documents to pass between the rollers. There is a second pair of feed roller apparatus mounting the second pair of feed rollers in spaced relationship with the first pair of feed rollers in an upstream direction with respect to the first pair. The feed rollers of the second pair of feed rollers are normally spaced apart to allow a plurality of documents to accumulate therebetween. There is a driving apparatus for driving at least one roller of each of the first and second pairs of rollers. There is a support apparatus lying in a predetermined plane on which the documents accumulate, the support apparatus extending between the first and second pairs of feed rollers, and there is an apparatus for feeding documents along the support apparatus seriatim and one on top of another to the nip of the first pair of feed rollers while the latter are stationary. As a result, the documents accumulate to form a stack with the lead edges of the documents disposed in a shingled relationship as determined by the arcuate contour of the periphery of one of the first pair of feed rollers. There is an actuating device, responsive to input signals for causing the second pair of feed rollers to drivingly engage the stack and for commencing rotation of the first and second pairs of feed rollers. A guide device located on the downstream side of the first pair of feed rollers is lying in a plane disposed at an angle with respect to the plane of the support apparatus. Therefore, as the stack of documents traverses the arcuate contour of one roller of the first pair of feed rollers in moving from the support apparatus to the plane of the guide device, the documents of the stack shift with respect to one another so that the lead edge of the documents are in aligned relationship after the stack is moving along the guide device.

The actuating device previously mentioned includes a first device responsive to a first input signal for causing a movable support apparatus to move the other feed roller of the second pairs of feed rollers towards one feed roller thereof until both of the feed rollers are in firm driving engagement with the stack of documents. A second actuating device is interposed in the driving apparatus, operable in response to a second input signal to cause operation of the driving apparatus to drive the one roller of each of the first and second pairs of feed rollers.

The preceding brief summary of the invention describes the invention where a stack of documents is accumulated and shingled for feeding along a diverted guide path for realigning in registration the stack prior to folding all documents along a first fold. It is, therefore, a primary object of the present invention to provide a device for accumulating a stack of documents in a predetermined shingled arrangement prior to advancing the stack forward to a folding device where all individual documents in the stack are folded equally at one time, with respect to one another.

It is another object of the present invention to provide a process for aligning a stack of documents so that all documents are shifted into aligned relationship with each other while they are advanced along an angular path, away from the normal path through a paper handling apparatus.

Figure 2A:
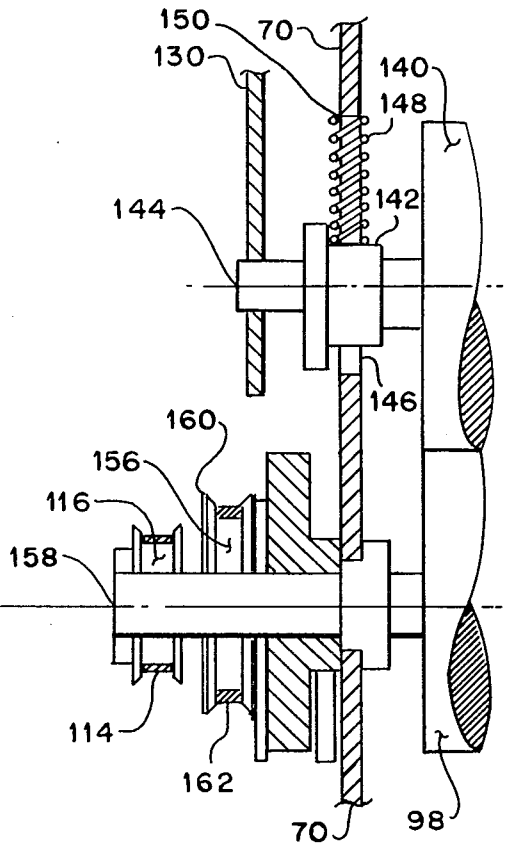
FIG. 2 represents an enlarged view taken along the lines of FIG. 1 showing the first and second pairs of feed rollers, the mounting apparatus for the first and second pairs of feed rollers, a portion of the mounting apparatus for the feed rollers, and a portion of the feeding apparatus for the feed rollers.
Figure 2:
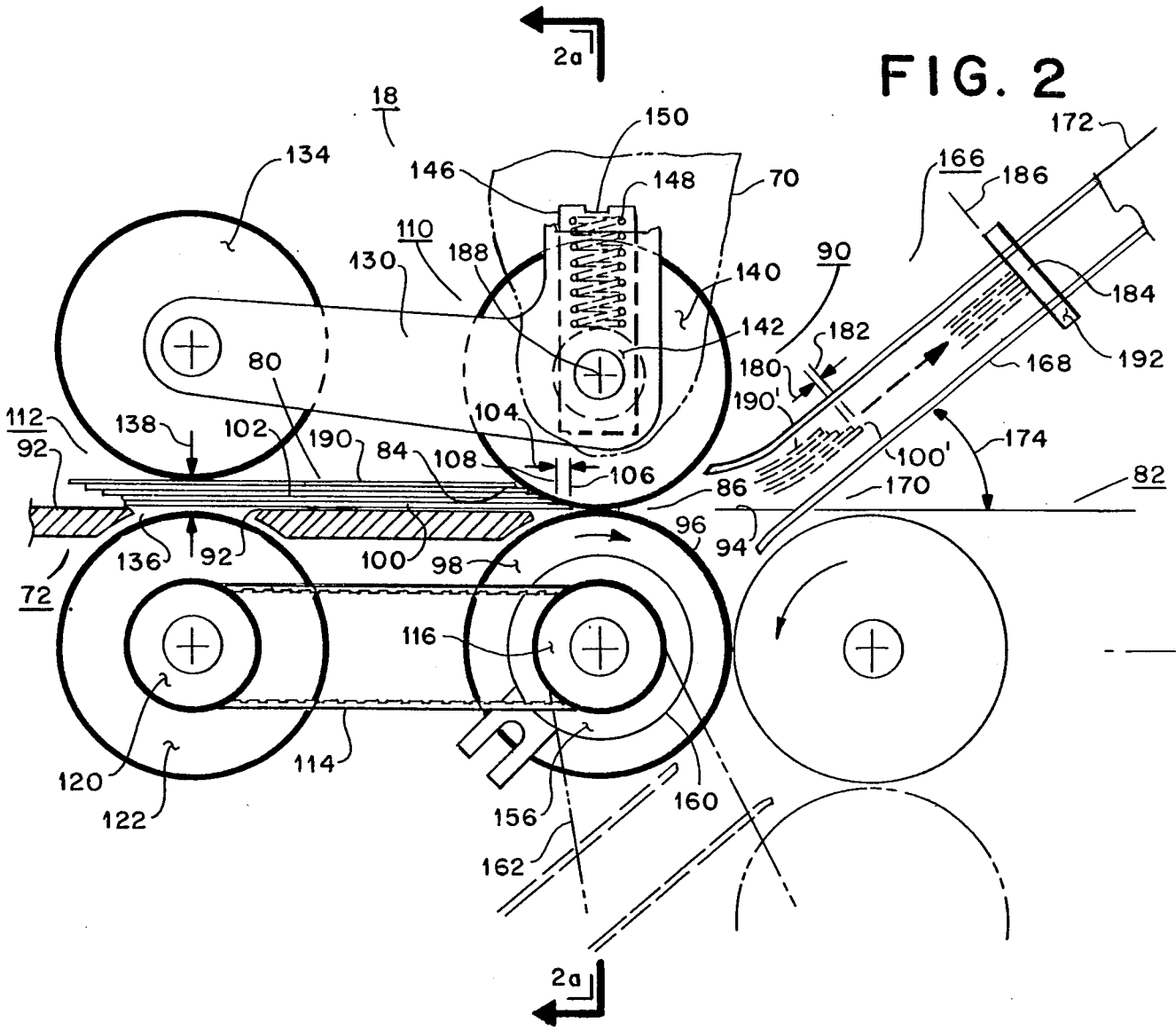

FIG. *2a* is a partial section view taken from FIG. 2 along the lines of *2a—2a,* showing the details for mounting the first pair of feed rollers.

DESCRIPTION OF THE PREFERRED EMBODIMENT

The present invention relates to a machine for accumulating documents burst or cut documents burst from a continuous, perforated web which is fed into the machine and guided towards a path leading to a folding device, capable of producing a fold on a plurality of documents at once.

Figure 1:
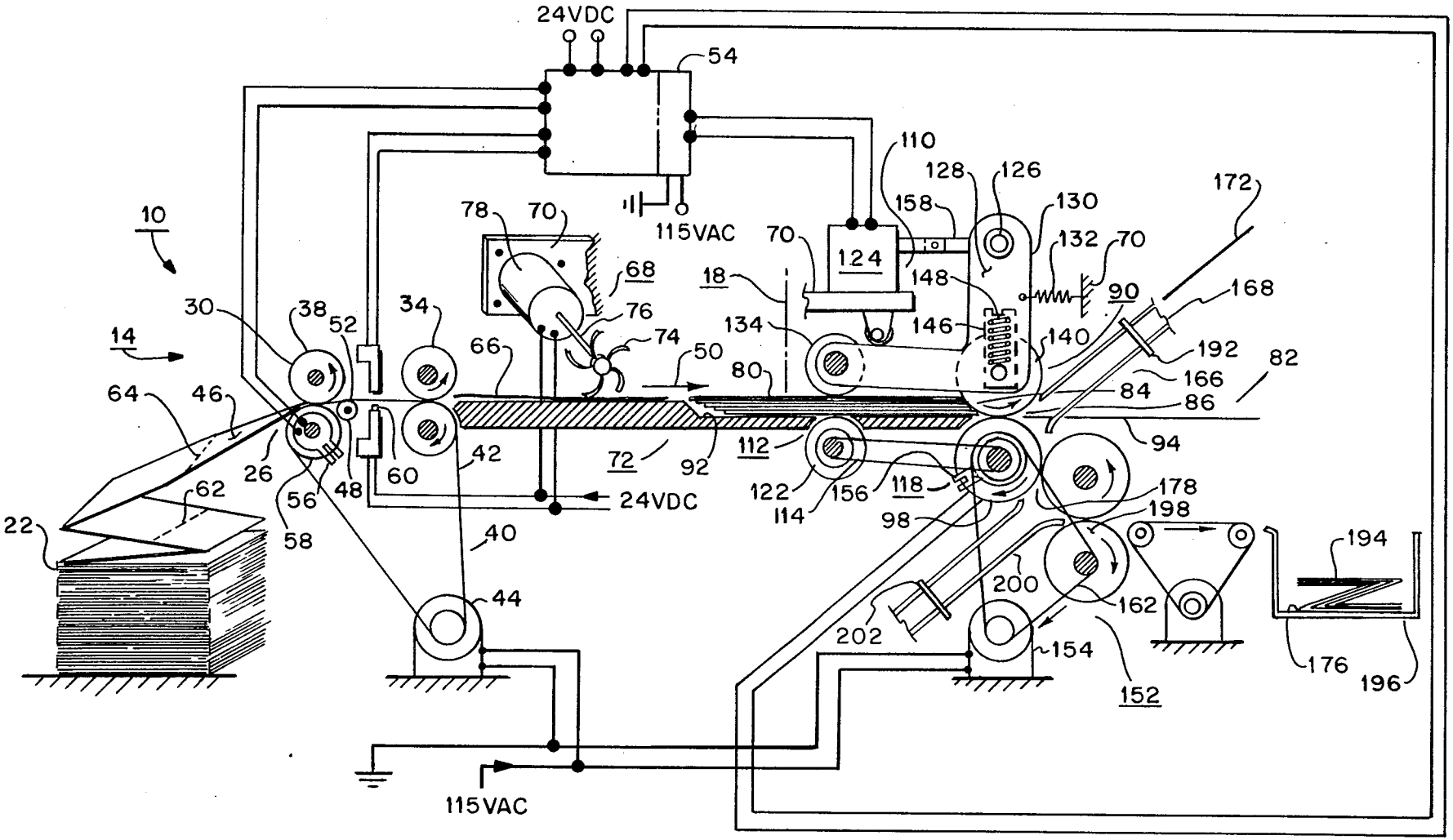
FIG. 1 represents a schematic side view of the machine of the present invention, illustrating the feeding rollers, mounting apparatus for the feed rollers, the driving apparatus, the support apparatus, the apparatus for feeding documents, the actuating apparatus, and the guide device.

Shown in FIG. 1, the machine is supplied with a continuous perforated web led into a bursting machine for separating documents disposed in the web prior to accumulating a stack of documents and advancing the stack into a folding device. The present invention is particularly directed to folding of a stack of documents so that a uniform fold is provided in all documents of the stack of documents which is accumulated at feeding apparatus consisting of several pairs of feed rollers.

Referring to FIG. 1, there is illustrated a document processing machine 10. Included in the document processing machine 10, there is a bursting apparatus 14, and a stacking apparatus 18. A supply of pre-printed computer form documents 22 is positioned at an entrance side 26 of the document processing machine 10, and is guided into the bursting apparatus 14 at an upstream end 30. The bursting apparatus 14 has two pairs of conveying rollers. There is a first pair of conveying rollers 34, and a second pair of conveying rollers 38 which are driven by a connecting drive system 40. The connecting drive system 40 has a timing chain 42 which is operatively connected to a drive motor 44, and is connected through chain sprocket members on one end (not shown) of one of the rollers in each of the first and second pairs of rollers 34 and 38, respectively.

The supply of pre-printed computer form documents 22 is perforated transversely to provide individual discreet documents in a web form 46. The web form 46 is guided through the bursting apparatus 14 such that it is conveyed by the first and second pair of conveying rollers 34 and 38, respectively. There is a bursting cone 48 disposed in a path of travel 50 of the web form 46, such that a top surface 52 of the bursting cone 48 is in a plane which slightly interferes with the normal path of travel 50 of the web form 46. There is an electromagnetic clutch and brake device 56, axially located on a lower roller 58 of the second pair of conveying rollers 38. A scanning device 60 reads a predetermined printed code 62 on the web form 46. The predetermined printed code 62 is used to control the electromagnetic clutch and brake device 56 located on the second pair of conveying rollers 38. When the appropriate code 62 is read by the scanning device 60, the clutch portion of the clutch and brake device 56 which normally maintains the second pair of conveying rollers 38 in a rotating condition is disabled, and the brake portion of the clutch and brake device 56 maintains the second pair of conveying rollers 38 in a stopped condition while the first pair of conveying rollers 34 continues to advance the web form 46. The scanning device 60 sends a signal to an electronic control and counting device 54 which causes the aforementioned clutch and brake activation to occur at a time when a transverse perforation 64 of the web form 46 is located over the top portion 52 of the bursting cone 48 such that a discreet document 66 is burst from the web form 46.

After a discreet document 66 is separated from the web form 46, the brake portion of the clutch and brake device 56 previously holding the second pair of conveying rollers 38 is disabled, and the clutch portion of the clutch and brake device 56 enabled which causes the leading end of a subsequent discreet document remaining attached to the web form 46 to travel towards the first pair of conveying rollers 34 for a repeated operation of bursting another document from the web form 46. There is a feeding apparatus 68 fastened to a fixed structure 70 located over a support apparatus 72. A document urge wheel 74, attached to a shaft 76 of a continuously driven DC motor 78, maintains the documents moving along the path of travel 50 towards the stacking apparatus 18.

A stack of documents 80 accumulates on the support apparatus 72 which constitutes a first plane 82, for causing alignment of the documents with certain apparatus of the stacking device 18 to now be explained. The support surface 72 is provided to ensure that the stack of documents 80 aligns properly at a leading end 84 with respect to a nip 86 of a first pair of feed rollers 90. The alignment of the documents is accomplished so that there is a staggered or shingled relationship of the documents at the leading end 84 as will now be discussed in detail. Referring to FIG. 2, there is shown an enlarged view of the support apparatus 72, in the area of the stacking device 18. A surface 92, which forms a horizontal guide and support for the stack of documents 80, is part of the support apparatus 72, and is arranged substantially tangent to a line 94 drawn to an outer diametrical surface 96 of a lower roller 98 of the first pair of feed rollers 90. There is a first document 100, lying directly on top of the surface 92. A second document 102 lies on top of the first document 100 such that there is a shingled step 104 between a leading end 106 of the first document 100, and a leading end 108 of the second document 102. There is a repeated pattern of shingled steps with the accumulation of additional documents on top of the first and second documents 100 and 102 until a total of five documents lies in registration in the desired shingled manner described above.

The document processing machine 10 is programmed to accept up to five documents at the stacking device 18. However, it is pointed out that there is no reason that more than five documents (in the stack of documents 80), cannot be processed through this system. The present description covers one operation utilized by the U.S. Post Office, where a perforated web may carry up to five $8\frac{1}{2} \times 11$ size documents constituting a letter. Accordingly, the apparatus described herein stacks five documents in shingled relationship and then folds them, as will now be described.

Referring back to FIG. 1, there is an actuating apparatus 110 in the stacking device 18 for causing a second pair of feed rollers 112 to drivingly engage the stack of documents 80. There is a timing belt 114 (FIG. 2) which is part of a drive apparatus 118 for positively driving the lower rollers of the first and second pairs of feed rollers 90 and 112, respectively. There is a timing pulley 116, and a timing pulley 120 (FIGS. 2 and 2*a*), which suspends the timing belt 114 between the lower roller 98 of the first pair of feed rollers 90 and a lower roller 122 of the second pair of feed rollers 112. A solenoid 124 is suitably fastened to the fixed structure 70 of the frames (partially shown) of the document processing machine 10. The solenoid 124 is connected to a bar 126 which is suitably fastened to an arm 128 of a bell crank 130, of which there is one each bell crank 130 located on either outer end of the first and second pairs of feed rollers 90 and 112, respectively, for holding the same. There is a spring member 132, suitably attached to the fixed structure 70 and to the arm 128 of each bell crank 130 in order to resiliently bias an upper roller 134 of the second pair of feed rollers 112 away from the rotatably fixed, lower roller 122 of the same pair of rollers 112. The lower roller 122 projects through an appropriate aperture 136 in the surface 92, in order to provide rotation to the upper roller 134 through the normal forces and resulting frictional components involved with cooperating biased feed rollers which when actuated tend to propel material disposed therebetween.

Since the second pair of feed rollers 112 is normally spaced apart, there is a gap 138 (FIG. 2) for the documents to move through in order to reach the first pair of feed rollers 90 as previously described to achieve the desired shingled stack with the shingled leading end 84 of the stack of documents 80. The first pair of feed rollers 90 is journaled such that the lower roller 98 is rotatably supported in appropriate bearings, fixed to side frames forming part of the fixed structure 70, (partially shown), while an upper roller 140 of the second pair of feed rollers 90 is supported in a bearing 142, located typically at an outside end 144 of the upper roller 140, (FIG. 2*a*) such that the bearing 142 may slide vertically in a slot 146 of the fixed structure 70 against a compression spring member 148. Each compression spring member 148 bears against and is trapped by a tab 150 as well as the bearing 142, at both outside ends of the upper roller 140, and yields at such time as the stack of documents 80 is pushed along the surface 92, into the first pair of feed rollers 90.

Referring back to FIG. 1, there is shown schematically a drive system 152, which supplies rotative power to the drive apparatus 118 and which is appropriately engaged with a constantly running drive motor 154, and to an electromagnetic clutch device 156 mounted on one end (FIG. 2*a*) of the lower roller 98 of the first pair of feed rollers 90. The electronic control and counting device 54 associated with the electrical controls of the document processing machine 10 will recognize and count up to five documents which have passed the scanning device 60, and have been accumulated at the stacking device 18. At this time, the solenoid 124 is energized through a predetermined logic control system in the electronic control and counting device 54. Since the solenoid 124 is connected by a link 158, to the bar 126, of the actuating apparatus 110 previously described, the upper roller 134 of the second pair of feed rollers 112 thereby clamps the stack of documents 80. After a slight delay of 10 milliseconds, the electrical control and counting device 54 causes the drive system 152, and electrical engagement of the aforementioned electromagnetic clutch device 156. The electromagnetic clutch device 156 is appropriately fastened to an end 158 of the lower roller 98, such that a pulley 160 transmits rotative power from a belt 162, of the drive system 152, which is appropriately connected and engaged to the drive motor 154. Therefore, the lower roller 122 of the second pair of feed rollers 112 rotates as well through power provided through the timing belt 114. Since the upper roller 134 of the second pair of feed rollers 112 is resiliently biased against the lower roller 122, the stack of documents 80 immediately begins to move along the surface 92. The stack of documents 80 is then caused to positively move along the first plane 82 towards a document guide device 166, which constitutes a first buckle chute 168 located on a downstream side 170 of the document processing machine 10. The first buckle chute 168 is arranged in a second plane 172 disposed at an angle 174 with respect to the path of travel 50 over the support surface 92, so that a first fold 176 (FIG. 1) on the stack of documents 80 can take place. It is well known that rollers such as a pair of rollers 178 normally biased together and driven from the belt 162, will cause documents to fold over. Reference may be made to such patents as U.S. Pat. No. 3,797,196 issued to C. H. Harbison within which suitable explanation will be found as to the workings of rollers as they relate to folding machines and the like.

Referring to FIG. 2 again, the action upon the stack of documents 80, being pushed up the first buckle chute 168, is illustrated with an incremental gradual decrease of the shingled step 104 to a smaller step 180, as seen at a first downstream position 182 of the first buckle chute 168.

There is a further decrease of the smaller step 180 to a condition where no step at all exists, as indicated by the leading end 184 of the stack of documents 80 having moved to a furthest position 186 within the first buckle chute 168 where all respective documents in the stack 80 are aligned to form a squared end. The squaring of the end of the stack of documents 80 occurs because of the change in the path of travel the stack 80 is pushed along in respect to the first plane 82 and the second plane 172 and the relative differences in lengths of the paths of travel. For example, there is a difference in radial dimension from a center 188 of the roller 140 to the outermost document such as the first document 100 which travels a relatively longer distance while being advanced by the first and second pairs of feed rollers 90 and 112, respectively, as compared to an innermost document 190.

Referring once again to FIG. 2, it will be seen that the first document 100 having moved along up the first buckle chute 168 is noted as 100', and the innermost document 190 as 190', at the first downstream position 182. By the time the stack of documents 80 reaches the furthest downstream position 186, the leading end 84 is squared. It is pointed out that the furthest position 186 of the stack of documents 80 and the resulting squaring of the leading end 84 is not accomplished by the documents abutting into a stop 192 but rather being squared by the incremental motion and distance traveled, as described in the preceding text. There is a second buckle chute 200, having a stop 202, which receives the stack of documents 80, with the first fold 176, and which guides the folded stack of documents to a second pair of folding rollers 198.

It was previously mentioned that the description of folding documents with a roller type apparatus is well known and, therefore, reference may be made to the herein noted patent to that extent. The result of the folding of the stack of documents 80 is seen represented in FIG. 1 by a folded stack of documents 194 which has been appropriately transported to a receiving tray 196, after exiting the second pair of folding rollers 198, which are also appropriately journaled, supported and driven from the drive system 152 previously described.

Therefore, having described an embodiment of a device for aligning a stack of documents which are advanced along a path of travel, leading to a folding device so that the leading end of the stack of documents is squared prior to being folded, it will be recognized that the invention has been described with reference to the drawings enclosed, however, the invention is not limited to the details set forth and is intended to cover such modifications or changes as may come within the scope of the following claims.

What is claimed is:

1. A machine for accumulating and for stacking a plurality of documents in a first plane with the lead edge of the documents in a shingled relationship, and for feeding the accumulated stack of documents to a second plane disposed at an angle to the first plane with the lead edge of the documents in aligned relationship, said machine comprising;

A. a first pair of feed rollers,

B. means mounting said first pair of feed rollers so that one roller thereof is movable toward and away from the other and is biased toward the other in driving engagement therewith so as normally to define a nip between said pair of feed rollers, the bias being sufficiently yieldable to permit a stack of documents to pass between said feed rollers, C. a second pair of feed rollers, D. means mounting said second pair of feed rollers in spaced relationship with said first pair of feed rollers in an upstream direction therefrom, the feed rollers of said second pair of feed rollers being normally spaced apart to allow a plurality of documents to accumulate therebetween, E. means for driving at least one roller of each of said first and second pairs of feed rollers, F. support means lying in a predetermined plane on which the documents accumulate, said support means extending between said first and second pairs of feed rollers, G. means for feeding documents along said support means seriatim and one on top of another to said nip of said first pair of feed rollers while the latter are stationary whereby the documents accumulate to form a stack with the lead edges of the documents disposed in a shingled relationship as determined by the arcuate contour of the periphery of one of said first pair of feed rollers, H. actuating means responsive to input signals for causing said second pair of feed rollers to drivingly engage said stack, and for commencing rotation of said first and second pairs of feed rollers, and I. guide means located on the downstream side of said first pair of feed rollers and lying in a plane disposed at an angle to said plane of said support means, whereby, as the stack of documents traverses the arcuate contour of said one roller of said first pair of feed rollers in moving from said support means to the plane of said guide means, the documents of said stack shift with respect to one another so that the lead edge of the documents are in aligned relationship after said stack is moving along said guide means.

2. A device according to claim 1 wherein said means mounting said second pair of feed rollers comprises movable support means for selectively moving the other roller of said second pair of feed rollers toward and away from said one of said second pair of feed rollers.

3. A device according to claim 2 wherein said actuating means comprises;

A. a first device responsive to a first input signal for causing said movable support means to move said other feed roller of said second pair of feed rollers toward said one feed roller thereof until both said feed rollers are in firm driving engagement with the stack of documents, and B. a second actuating device interposed in said driving means and operable in response to a second input signal to cause operation of said driving means to drive said one roller of each of said first and second pairs of feed rollers.

4. A device according to claim 3 further including control means for causing a time delay between said first input signal and said second input signal whereby said second actuating device cannot operate to cause operation of said driving means until after said first actuating device has caused said second pair of feed rollers to drivingly engage said stack of documents.

5. A device according to claim 1 wherein;

A. said means mounting said first pair of feed rollers includes a shaft movably mounted on said machine, said shaft carrying one of the feed rollers of said first pair of feed rollers, said shaft being biased toward the other feed roller of said pair of feed rollers, said shaft being biased toward the other feed roller of said first pair of feed rollers, B. said means for mounting said second pair of feed rollers including a lever pivotally mounted on said shaft and carrying one of the feed rollers of said second pair of feed rollers on the free end thereof, and C. said actuating means for causing said second pair of feed rollers to drivingly engage said stack comprising means for oscillating said lever about said shaft to move said one feed roller of said second pair of feed rollers toward the other feed roller of said pair.

* * * * *